US007220188B2

(12) United States Patent
Lee

(10) Patent No.: US 7,220,188 B2
(45) Date of Patent: May 22, 2007

(54) GOLF GLOVE FOR PROMOTING SWING ACCURACY

(76) Inventor: Jae Soo Lee, 16610 Shenandoah Ave., Cerritos, CA (US) 90703

( * ) Notice: Subject to any disclaimer, the term of this patent is extended or adjusted under 35 U.S.C. 154(b) by 181 days.

(21) Appl. No.: 11/148,099

(22) Filed: Jun. 8, 2005

(65) Prior Publication Data

US 2006/0281573 A1 Dec. 14, 2006

(51) Int. Cl.
*A63B 69/36* (2006.01)

(52) U.S. Cl. ..... 473/205

(58) Field of Classification Search ..... 473/205, 473/212, 213, 61, 62; 2/161.2, 161.4, 159, 2/160, 162

See application file for complete search history.

(56) References Cited

U.S. PATENT DOCUMENTS

| | | | | |
|---|---|---|---|---|
| 3,606,342 | A | 9/1971 | Albertson, Jr. | |
| 3,865,383 | A * | 2/1975 | Clay et al. | 473/213 |
| 5,158,298 | A | 10/1992 | Goins | |
| 5,180,169 | A | 1/1993 | Choy | |
| 5,207,430 | A * | 5/1993 | Goins | 473/213 |
| 5,330,391 | A | 7/1994 | Mitchell | |
| 5,435,007 | A | 7/1995 | Kalvestran et al. | |
| 5,492,331 | A * | 2/1996 | Kawakami | 473/213 |
| 5,611,735 | A * | 3/1997 | Jackson | 473/60 |
| 5,797,803 | A | 8/1998 | Jung | |
| 6,526,592 | B1 | 3/2003 | Best | |
| 2002/0152537 | A1 * | 10/2002 | Litke | 2/161.4 |
| 2006/0281573 | A1 * | 12/2006 | Lee | 473/205 |

* cited by examiner

*Primary Examiner*—Raleigh W. Chiu
(74) *Attorney, Agent, or Firm*—John K. Park; Park Law Firm

(57) ABSTRACT

A golf glove comprising outer and inner sections connected to each other by a thumb line and a little finger line to become worn from fingers to substantially above a wrist and toward a user's arm is disclosed. The outer section has a finger portion, a knuckle portion, a backhand portion, a wrist portion, and an arm portion. A support pad embedded along the arm portion, the wrist portion and the backhand portion includes a backhand shingle having a lower end, an arm shingle having a first edge, a second edge, and an upper end. The upper end of the arm shingle is pivotably engaged to the lower end of the backhand shingle so that the backhand shingle makes an angular rotation against the arm shingle. A first flex wing extends from the first edge to become perpendicular to the arm shingle and to approach the thumb line.

23 Claims, 4 Drawing Sheets

GOLF GLOVE FOR PROMOTING SWING ACCURACY

BACKGROUND OF THE INVENTION

The invention relates to a golf glove. More particularly, the present invention relates to an improved golf glove which promotes club swing accuracy by stabilizing the posture of a golfer's hand and wrist from address to club swing while providing flexibility in the hand's sidewise movement.

As generally understood among golfers, a golfer's swing accuracy is generated by combination of body movements relative to club swings. For example, a golfer's grip is faulty, the golfer may not have control of club when he reaches the top of his backswing, thereby failing to shot the ball to a target point. To further facilitate grip and swing motion, a golf glove is worn on one hand that grips over the club handle with the other hand slightly covering finger portions of the glove-clad hand. A golf swing accuracy is known to substantially improve if the glove-clad hand is maintained without backward or forward leaning during the entire swing. So a prior art introduces a wrist support provided as an attachment to a golf glove in order to prevent the unwanted forward or backward leaning of a golfer's wrist during swing motion.

U.S. Pat. No. 5,286,391 discloses a sports glove for a bowler including a glove body having sleeves, a flexible cover attached to the sleeves to form a pouch, and cushioning pad disposed in the pouch to weight distribution and balance a bowler grabbing a bowling ball. Applicant believes that a bowler glove designed to efficiently hold a bowling ball is inapplicable to a golf glove dealing with a club swing mechanism for a golf player.

U.S. Pat. No. 3,606,302 discloses a wrist control device having a hand member for engaging the back of the hand, an independent arm member for engaging the top of the arm above the wrist, a pivot means pivotally connecting the members together for pivotal movement relative to one another. Applicant believes that this lacks stability due to instability of the independent arm member.

U.S. Pat. No. 5,158,298 discloses a golf training apparatus with an arm guide secured to the off arm of a golfer. A wrist guide pivotably attached to the arm guide and positioned on the hand of a golfer leads to the pivotal attachment of the wrist guide to the arm guide to ensure that the golfer's hand pivots relative to the forearm. Applicant believes that this resembles the '302 patent in light of lacking stability caused by instability of the wrist guide. Further, this '298 patent is designed to aid golf beginners, resulting in inapplicability to general application for golfing.

A demand is to provide a flexible wrist support clad to a glove, which allows the wrist to naturally move side to side while preventing backward or forward leaning of the A demand is to provide a flexible wrist support clad to a glove, which allows the wrist to naturally move side to side while preventing backward or forward leaning of the wrist.

SUMMARY OF THE INVENTION

Accordingly, it is an object of the present invention to provide a golf glove promotes club swing accuracy by stabilizing the posture of a golfer's hand and wrist from address to club swing while providing flexibility in the hand's sidewise movement.

Another object is to protect a golfer's hand and wrist by enabling a support pad to safely support the golfer's backhand, thereby improving product reliability.

To achieve the above-described objects, the golf glove according to the present invention comprises outer and inner sections connected to each other by a thumb line and a little finger line to become worn from fingers to substantially above a wrist and toward an arm of a user where the outer section has a finger portion, a knuckle portion, a backhand portion, a wrist portion, and an arm portion. The inner section serves to cover along the user's palm. A support pad is embedded along the arm portion, the wrist portion and the backhand portion where the support pad comprises a backhand shingle having a lower end, a backhand wing outwardly extending from each side of the backhand shingle where the backhand wing is substantially curved along a curvature of the user's backhand, an arm shingle having a first edge, a second edge, and an upper end, where the upper end of the arm shingle is pivotably engaged to the lower end of the backhand shingle so that the backhand shingle makes an angular rotation against the arm shingle when required, and a first flex wing extending from the first edge of the arm shingle to become substantially perpendicular to the arm shingle and to approach the thumb line.

The backhand wing is substantially flappable relative to the backhand shingle and the support pad further comprises a second flex wing extending from the second edge of the arm shingle to become substantially perpendicular to the arm shingle toward the little finger line. For a better performance, the little finger line is severed along the arm portion and the wrist portion, and an arm strap is attached to the inner section along the little finger line and detachably attached to the outer section corresponding to the first flex wing. Here, the detachable attachment of the arm strap is implemented by a hook and pile mechanism.

Selectively, the little finger line is severed along the arm portion, the wrist portion and the backhand portion so the golf glove may further comprise an arm strap attached to the inner section along the little finger line corresponding to the arm portion and detachably attached to the outer section corresponding to the first flex wing, and a backhand strap attached to the inner section along the little finger line corresponding to the backhand portion and detachably attached to the outer section adjacent to the backhand shingle. Here, the detachable attachment of said each strap is implemented by a hook and pile mechanism.

The backhand shingle is substantially leaned over the arm shingle and an angle formed by the arm shingle and the leaned-over backhand shingle is between about three degrees and about ten degrees. Preferably, the angle formed by the arm shingle and the backhand shingle is about seven degrees. The upper end of the arm shingle is arc-shaped and has a quirk formed along an end line thereof, and the lower end of the backhand shingle is substantially surface-ground to rotatably fit in the quirk, thereby enabling the backhand single to pivotably rotate relative to the arm shingle.

The support pad may further comprise a pivot rotatably inserted through each end of the arm shingle and the backhand shingle. In an embodiment, the first flex wing serves to flexibly hook the user's arm corresponding to the thumb line.

The advantages of the present invention are numerous in that: (1) since the support pad is sidewisely rotatable while safely supporting the golfer's backhand during a club swing, the golfer's left hand (when she or he is right handed) is stably controlled with ease, thereby improving club swing accuracy; (2) The pivotable mechanism applied between the arm shingle and the backhand shingle substantially improves flexibility of the sidewise movement of the golfer's hand during the club swing, thereby protecting the golfer's hand and wrist; (3) since the support pad can be embedded in a pad base of the golf glove, the glove can be easily put on for club swing or taken off for relaxing on the green field, thereby improving usability and reliability, and (4) the flex wing extending from the side edge of the arm shingle further stabilizes the user's grip on the club in coordination with the detachable attachment of each strap, thereby maximizing the user's satisfaction.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
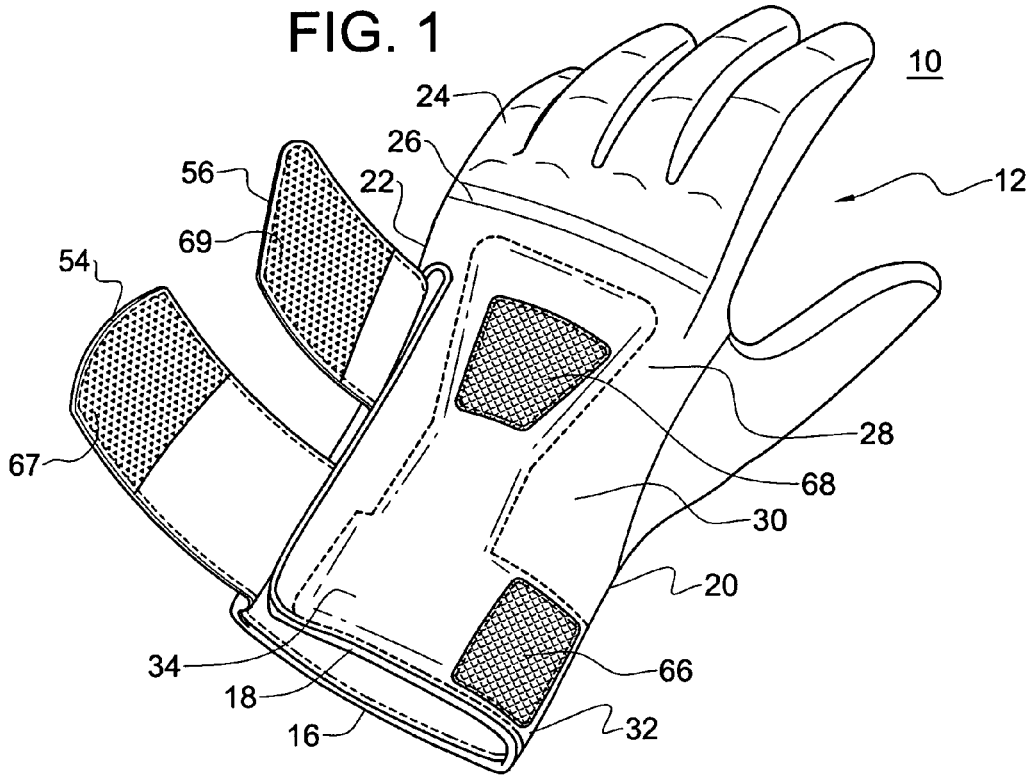
FIG. 1 is a perspective view showing a golf glove for improving club swing accuracy according to the present invention.
Figure 2:
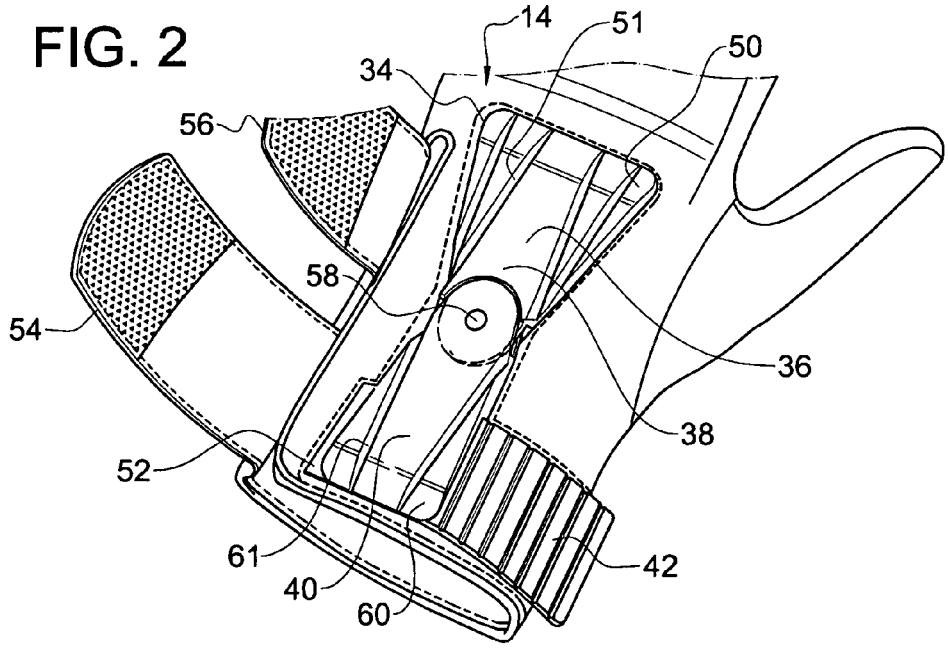
FIG. 2 is a view showing a support pad embedment in FIG. 1.
Figure 3:
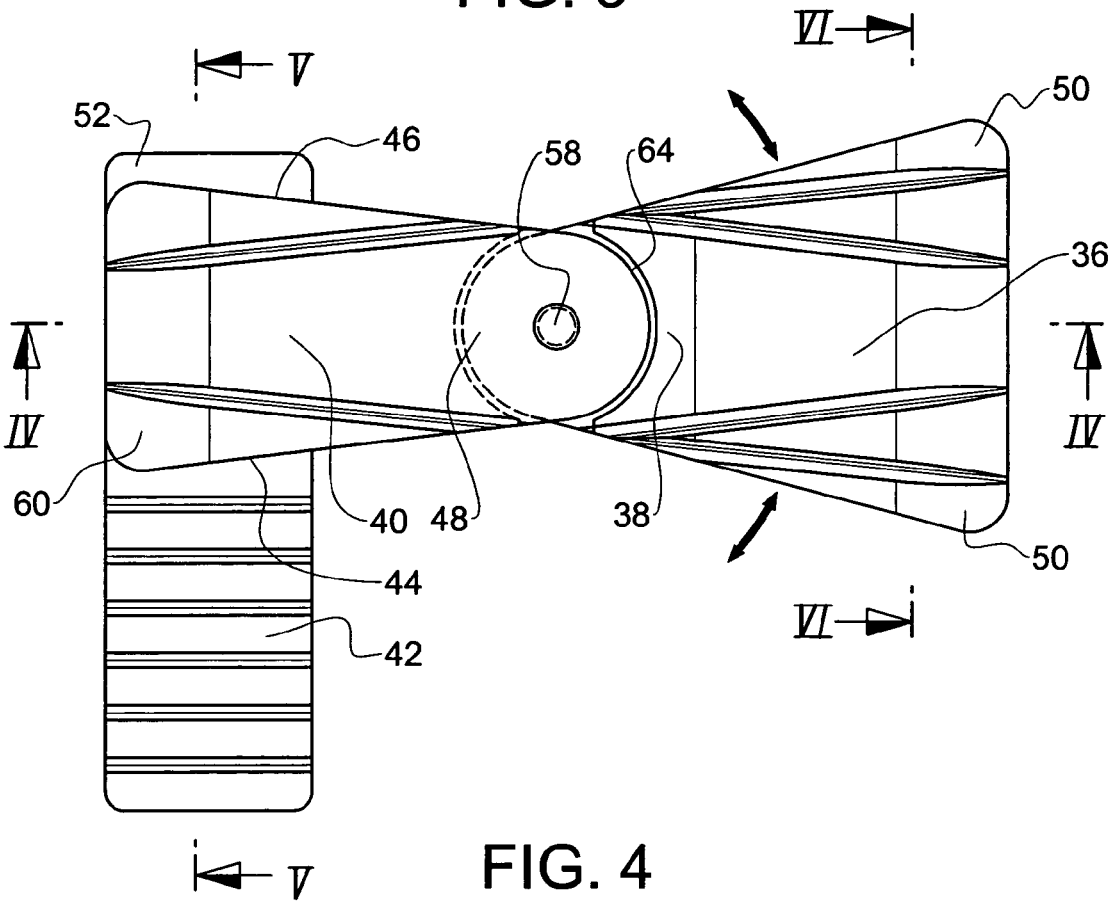
FIG. 3 is a top view showing a support pad in FIG. 2.
Figure 4:
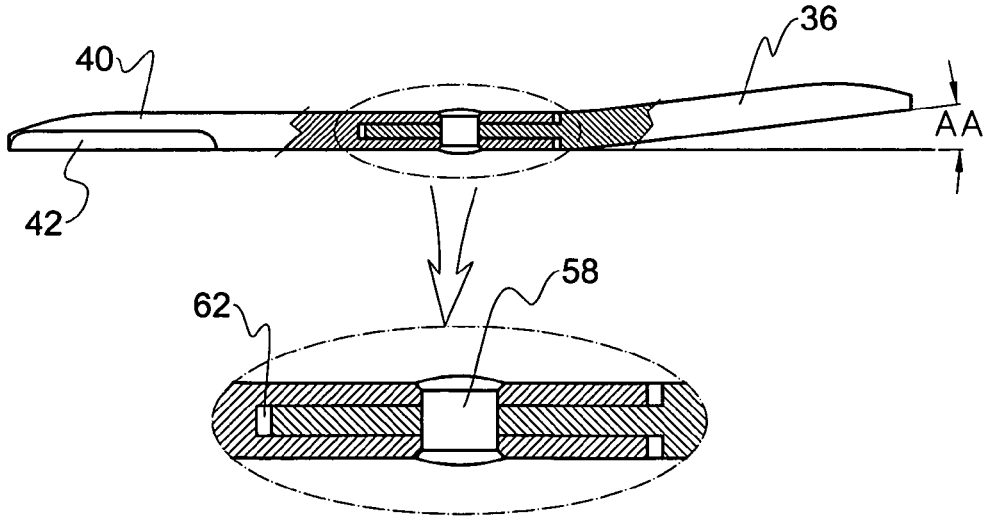
FIG. 4 is a cross-sectional view taken along line IV—IV in FIG. 3.
Figure 5:
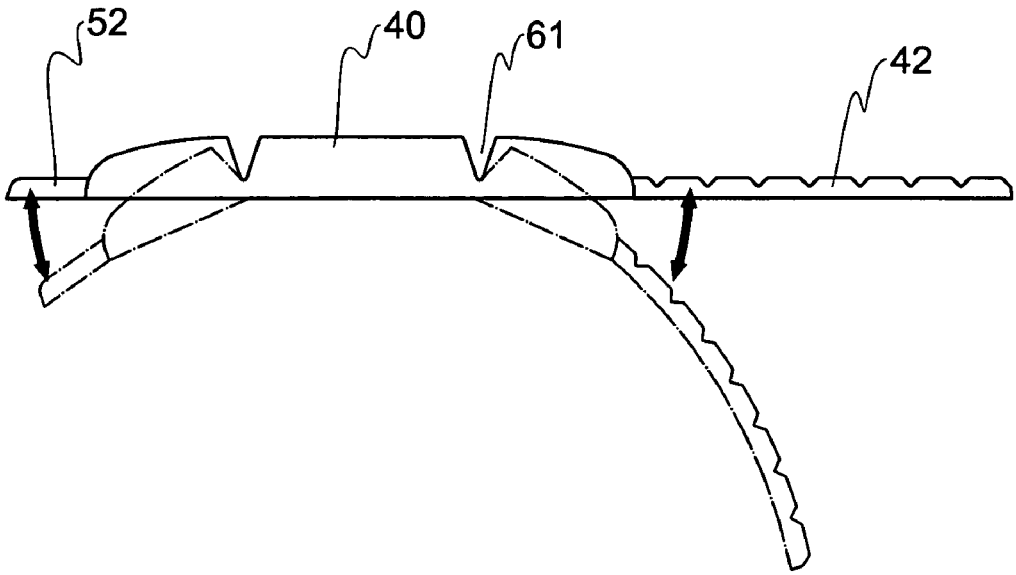
FIG. 5 is a cross-sectional view taken along line V—V in FIG. 3.
Figure 6:
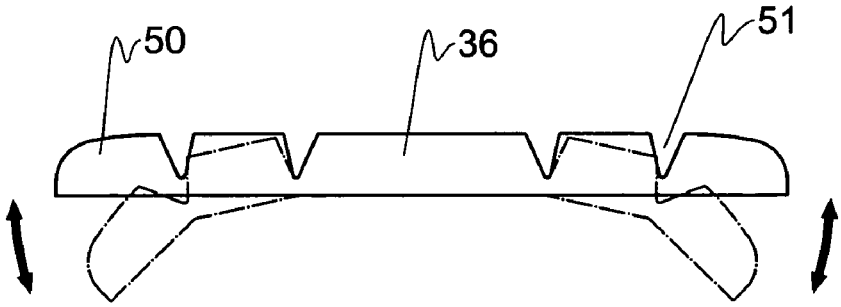
FIG. 6 is a cross-sectional view taken along line VI—VI in FIG. 3.

FIG. 1 shows an overall view of a golf glove 10 for improving club swing accuracy according to the present invention and FIG. 2 shows another overall view showing a pad attachment mechanism. As shown therein, the golf glove 10 includes a glove part 12 and a support pad 14. The glove part 12 comprises outer and inner sections 16, 18. The outer and inner sections 16, 18 of the glove part 12 are connected to each other by a thumb line 20 and a finger line 22 to form the glove part 12 which becomes worn on a golf player's hand. The thumb and finger lines 20, 22 may correspond to a general sewing line of a known glove, where the thumb line 20 begins from the outer line of the thumb toward a user's lower arm and the little finger line 22 begins from the bottom line of the little finger toward the opposite side of the thumb line 20.

The outer section 18 of the glove part 12 is partitioned to a finger portion 24, a knuckle portion 26, a backhand portion 28, a wrist portion 30, and an arm portion 32. Meanwhile, the inner section 16 of the glove part 12 serves to cover along a palm, inner sides of the fingers and arm of the golf player whose hand and partial arm are worn in the glove part 12. That is, the glove part 12 incorporated by the outer and inner sections 16, 18 can be worn from fingers to substantially above a wrist and toward an arm of its user or golf player.

In a preferred version, a pad base 34 is reserved along the arm portion 32, the wrist portion 30 and the backhand portion 28 of the outer section 18 of the glove part 12 so that the support pad 14 becomes embedded in the pad base 34. That is, the support pad 14 is embedded along the arm portion 32, the wrist portion 30 and the backhand portion 28. Preferably, the pad base 34 is double-layered.

As further shown in FIGS. 2–8, the support pad 14 comprises a backhand shingle 36 having a lower end 38, an arm shingle 40, and a first flex wing 42. The arm shingle 40 has a first edge 44, a second edge 46, and an upper end 48. The upper end 48 of the arm shingle 40 is pivotably engaged to the lower end 38 of the backhand shingle 36 so that the backhand shingle 36 makes an angular rotation against the arm shingle 40 when required. The first flex wing 42 is provided to extend from the first edge 44 of the arm shingle 40 to become substantially perpendicular to the arm shingle 40 and to approach the thumb line 20. The backhand shingle 36 is preferably formed in a substantially triangular format so one angle side of the backhand shingle 36 serves as the lower end 38.

In an embodiment, the support pad 14 further comprises a backhand wing 50 outwardly extending from each side of the backhand single 36 so that the backhand wing 50 is substantially curved along a curvature of the user's backhand. Preferably, the backhand wing 50 may be substantially flappable relative to the backhand shingle 36. At least one groove 51 is formed along the backhand wing 50 in a lengthwise format to provide characteristic of its flexible bending along the curvature of the user's backhand.

For a better performance, the support pad 14 is provided with a second flex wing 52 extending from the second edge 46 of the arm shingle 40 to become substantially perpendicular to the arm shingle 40 toward the little finger line 22. Here, the little finger line 22 is severed along the arm portion 32 and the wrist portion 30. In this construction, an arm strap 54 is attached to the inner section 16 along the little finger line 22 and detachably attached to the outer section 18 corresponding to the first flex wing 42 that serves to flexibly hook the user's arm corresponding to the thumb line 20. The detachable attachment of the arm strap 54 to the outer section 18 is implemented by a hook and pile mechanism.

Alternately, the little finger line 22 may be further severed along the arm portion 32, the wrist portion 30 and the backhand portion 28. In this mechanism, the arm strap 54 is paired with a backhand strap 56. The backhand strap 56 is preferably attached to the inner section 16 along the little finger line 22 corresponding to the backhand portion 28 and detachably attached to the outer section 18 adjacent to the backhand shingle 36. It is recommended that the detachable attachment of the backhand strap 56 is also implemented by a hook and pile mechanism.

In order to facilitate the angular rotation of the backhand shingle 36 relative to the arm shingle 40, a pivot 58 is rotatably inserted through the upper end 48 of the arm shingle 40 and the lower end 38 of the backhand shingle 36. Also, the backhand shingle 36 is formed to become substantially leaned over the arm shingle 40 so that an angle AA in FIG. 4, formed by the arm shingle 40 and the leaned-over backhand shingle 36 is between about three (3) degrees and about ten (10) degrees. In a preferred version, the angle AA formed by the arm shingle 40 and the backhand shingle 36 is about seven (7) degrees.

To further improve the performance of the support pad 14, a backhand wing 50 is formed to outwardly extend from each side of the backhand shingle 36 of the support pad 14. The backhand wing 50 is substantially curved along a curvature of the golf player's backhand. Also, an arm wing 60 may be selectively formed to outwardly extend from each side of the arm shingle 40. Here, the arm wing 60 is substantially curved along another curvature of the golf player's arm. The backhand and arm wings 50, 60 are formed to become substantially flappable relative to the corresponding shingles 36, 40. Here, at least one groove 61 is formed along the arm wing 50 in a lengthwise format to provide characteristic of its flexible bending along the curvature of the user's arm periphery.

Figure 7:
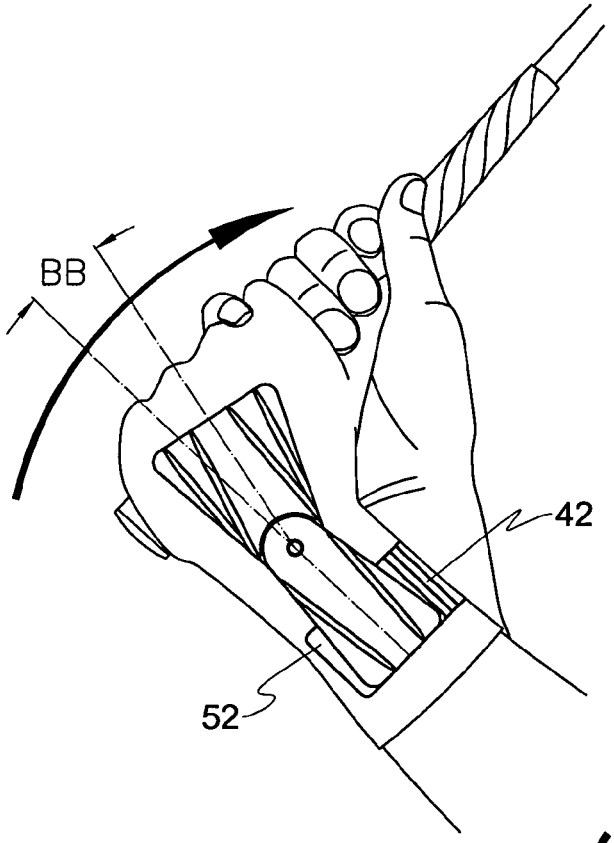
FIG. 7 is a function view showing relative rotation of a backhand shingle of the support pad during a backward swing of a golf club.
Figure 8:
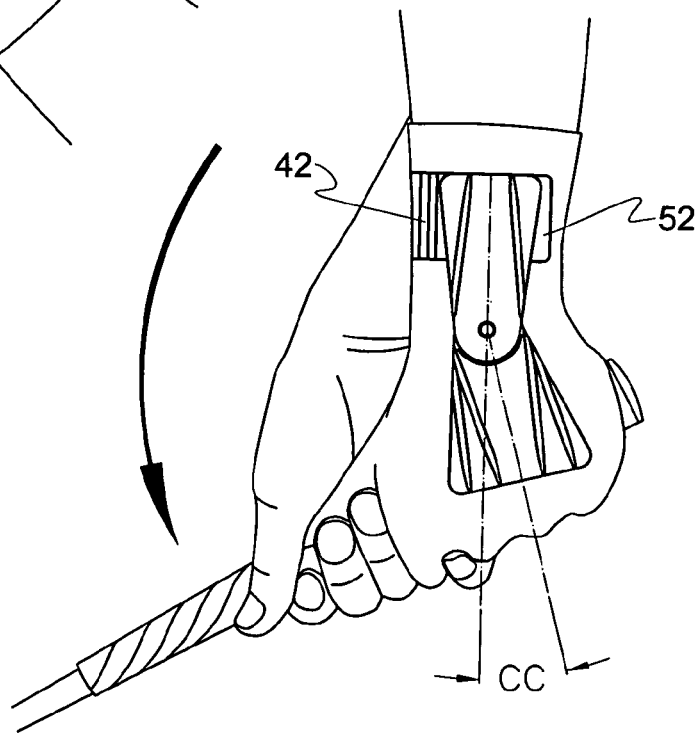
FIG. 8 is another function view showing relative rotation of a backhand shingle of the support pad during a downward swing of a golf glove.

Consequently, as shown in FIGS. 7 and 8, the golf glove 10 having the support pad 14 significantly stabilizes the backward swing in FIG. 7 and downward swing in FIG. 8, thereby improving club swing accuracy. Here, a rotation angles BB, CC of the backhand shingle 36 against the arm shingle 40 may range between about three (3) degrees and about fifteen (15) degrees during the backward or downward club swing.

FIGS. 3–6 are provided to further explain the mechanism of the support pad 14 in the golf glove 10. As shown therein, the upper end 48 of the arm shingle 40 is arc-shaped and has a quirk 62 formed along an end line 64 thereof. The lower end 38 of the backhand shingle 36 is substantially surface-ground to rotatably fit in the quirk 62, thereby enabling the backhand single 36 to pivotably rotate relative to the arm shingle 40 so that the backhand shingle 36 makes an angular rotation against the arm shingle 40 in a reliable format during a golf club swing of the golf player.

In a preferred mode, hooks 66, 68 may be selectively formed on the golf glove 10 to provide detachable attachments of the straps 67, 69. That is, piles 67, 69 formed on the straps 54, 56 are detachably attached on the corresponding hooks 66, 68 by flapping the straps 54, 56 over onto the pad base 34. Specifically, the arm strap pile 67 is detachably attached onto the corresponding hook 66 and the backhand strap pile 69 is detachably attached onto the hook 68. The arm portion side hook 66 is preferably formed on a portion of the pad base 34 corresponding to the arm flex wing 2, and the backhand portion side hook 68 is formed on another portion of the pad base 34 corresponding to the backhand shingle 36.

An advantage of the present invention is that since the support pad 14 is sidewisely rotatable while safely supporting the golfer's backhand during a club swing, the golfer's left hand (when she or he is right handed) is stably controlled with ease, thereby improving club swing accuracy. Further, the pivotable mechanism applied between the arm shingle 40 and the backhand shingle 36 substantially improves flexibility of the sidewise movement of the golfer's hand during the club swing, thereby protecting the golfer's hand and wrist.

In addition, since the support pad 14 can be inserted in the pad base 34 of the glove part 12, the golf glove 10 can be easily put on for club swing or taken off for relaxation on the green field, thereby improving usability and reliability. Also, the first flex wing 42 extending from the side edge 44 of the arm shingle 40 further stabilizes the user's grip on the club in coordination with the detachable attachment of each strap 54, 56 thereby maximizing the user's satisfaction Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A golf glove comprising:

a) outer and inner sections connected to each other by a thumb line and a little finger line to become worn from fingers to substantially above a wrist and toward an arm of a user, wherein the outer section has a finger portion, a knuckle portion, a backhand portion, a wrist portion, and an arm portion, wherein the inner section serves to cover along the user's palm; and b) a support pad embedded along the arm portion, the wrist portion and the backhand portion, wherein the support pad comprises:

i) a backhand shingle having a lower end;

ii) an arm shingle having a first edge, a second edge, and an upper end, wherein the upper end of the arm shingle is pivotably engaged to the lower end of the backhand shingle so that the backhand shingle makes an angular rotation against the arm shingle when required; and iii) a first flex wing extending from the first edge of the arm shingle to become substantially perpendicular to the arm shingle and to approach the thumb line.

2. The golf glove of claim 1 wherein the support pad further comprises a second flex wing extending from the second edge of the arm shingle to become substantially perpendicular to the arm shingle toward the little finger line.

3. The golf glove of claim 1 wherein the little finger line is severed along the arm portion and the wrist portion, wherein an arm strap is attached to the inner section along the little finger line and detachably attached to the outer section corresponding to the first flex wing.

4. The golf glove of claim 3 wherein the detachable attachment of the arm strap is implemented by a hook and pile mechanism.

5. The golf glove of claim 1 wherein the little finger line is severed along the arm portion, the wrist portion and the backhand portion, wherein the golf glove further comprises:

a) an arm strap attached to the inner section along the little finger line corresponding to the arm portion and detachably attached to the outer section corresponding to the first flex wing; and b) a backhand strap attached to the inner section along the little finger line corresponding to the backhand portion and detachably attached to the outer section adjacent to the backhand shingle.

6. The golf glove of claim 5 wherein the detachable attachment of said each strap is implemented by a hook and pile mechanism.

7. The golf glove of claim 1 wherein the backhand shingle is substantially leaned over the arm shingle, wherein an angle formed by the arm shingle and the leaned-over backhand shingle is between about three (3) degrees and about ten (10) degrees.

8. The golf glove of claim 7 wherein the angle formed by the arm shingle and the backhand shingle is about seven (7) degrees.

9. The golf glove of claim 1 wherein the upper end of the arm shingle is arc-shaped and has a quirk formed along an end line thereof, wherein the lower end of the backhand shingle is substantially surface-ground to rotatably fit in the quirk, thereby enabling the backhand single to pivotably rotate relative to the arm shingle.

10. The golf glove of claim 9 wherein the support pad further comprises a pivot rotatably inserted through said each end of the arm shingle and the backhand shingle.

11. The golf glove of claim 1 wherein the first flex wing serves to flexibly hook the user's arm corresponding to the thumb line.

12. A golf glove comprising:

a) outer and inner sections connected to each other by a thumb line and a little finger line to become worn from fingers to substantially above a wrist and toward an arm of a user, wherein the outer section has a finger portion, a knuckle portion, a backhand portion, a wrist portion, and an arm portion, wherein the inner section serves to cover along the user's palm; and b) a support pad embedded along the arm portion, the wrist portion and the backhand portion, wherein the support pad comprises:

i) a backhand shingle having a lower end;

ii) a backhand wing outwardly extending from each side of the backhand shingle, wherein the backhand wing is substantially curved along a curvature of the user's backhand;

iii) an arm shingle having a first edge, a second edge, and an upper end, wherein the upper end of the arm shingle is pivotably engaged to the lower end of the backhand shingle so that the backhand shingle makes an angular rotation against the arm shingle when required; and iv) a first flex wing extending from the first edge of the arm shingle to become substantially perpendicular to the arm shingle and to approach the thumb line.

13. The golf glove of claim 12 wherein the backhand wing is substantially flappable relative to the backhand shingle.

14. The golf glove of claim 12 wherein the support pad further comprises a second flex wing extending from the second edge of the arm shingle to become substantially perpendicular to the arm shingle toward the little finger line.

15. The golf glove of claim 12 wherein the little finger line is severed along the arm portion and the wrist portion, wherein an arm strap is attached to the inner section along the little finger line and detachably attached to the outer section corresponding to the first flex wing.

16. The golf glove of claim 15 wherein the detachable attachment of the arm strap is implemented by a hook and pile mechanism.

17. The golf glove of claim 12 wherein the little finger line is severed along the arm portion, the wrist portion and the backhand portion, wherein the golf glove further comprises:

a) an arm strap attached to the inner section along the little finger line corresponding to the arm portion and detachably attached to the outer section corresponding to the first flex wing; and b) a backhand strap attached to the inner section along the little finger line corresponding to the backhand portion and detachably attached to the outer section adjacent to the backhand shingle.

18. The golf glove of claim 17 wherein the detachable attachment of said each strap is implemented by a hook and pile mechanism.

19. The golf glove of claim 12 wherein the backhand shingle is substantially leaned over the arm shingle, wherein an angle formed by the arm shingle and the leaned-over backhand shingle is between about three (3) degrees and about ten (10) degrees.

20. The golf glove of claim 19 wherein the angle formed by the arm shingle and the backhand shingle is about seven (7) degrees.

21. The golf glove of claim 12 wherein the upper end of the arm shingle is arc-shaped and has a quirk formed along an end line thereof, wherein the lower end of the backhand shingle is substantially surface-ground to rotatably fit in the quirk, thereby enabling the backhand single to pivotably rotate relative to the arm shingle.

22. The golf glove of claim 12 wherein the support pad further comprises a pivot rotatably inserted through said each end of the arm shingle and the backhand shingle.

23. The golf glove of claim 12 wherein the first flex wing serves to flexibly hook the user's arm corresponding to the thumb line.

* * * * *